US008900436B2

(12) United States Patent
Berger et al.

(10) Patent No.: US 8,900,436 B2
(45) Date of Patent: Dec. 2, 2014

(54) PD AND PD-NI ELECTROLYTE BATHS

(75) Inventors: Sascha Berger, Schwaebisch Gmuend (DE); Frank Oberst, Schwaebisch Gmuend (DE); Franz Simon, Schwaebisch Gmuend (DE); Uwe Manz, Aalen (DE); Klaus Bronder, Schwaebisch Gmuend (DE); Bernd Weyhmueller, Alfdorf Hintersteinenberg (DE)

(73) Assignee: Umicore Galvanotechnik GmbH, Schwaebisch Gmuend (DE)

( * ) Notice: Subject to any disclaimer, the term of this patent is extended or adjusted under 35 U.S.C. 154(b) by 996 days.

(21) Appl. No.: 12/990,864

(22) PCT Filed: May 7, 2008

(86) PCT No.: PCT/EP2008/003667

§ 371 (c)(1),
(2), (4) Date: Jan. 28, 2011

(87) PCT Pub. No.: WO2009/135505

PCT Pub. Date: Nov. 12, 2009

(65) Prior Publication Data

US 2011/0168566 A1 Jul. 14, 2011

(51) Int. Cl.

| | |
|---|---|
| ***C25D 3/56*** | (2006.01) |
| ***C25D 3/50*** | (2006.01) |
| ***C25D 3/52*** | (2006.01) |

(52) U.S. Cl.

CPC . *C25D 3/52* (2013.01); *C25D 3/567* (2013.01)
USPC ..... 205/257; 205/259; 205/265

(58) Field of Classification Search

USPC ..... 205/257, 265, 259
See application file for complete search history.

(56) References Cited

U.S. PATENT DOCUMENTS

| | | | | | |
|---|---|---|---|---|---|
| 3,972,787 | A | | 8/1976 | Nobel et al. | 204/47 |
| 4,278,514 | A | | 7/1981 | Morrissey | 204/47 |
| 4,328,286 | A | * | 5/1982 | Crosby | 428/636 |
| 4,401,527 | A | * | 8/1983 | Duva et al. | 205/265 |
| 4,406,755 | A | | 9/1983 | Morrissey | 204/47 |
| 4,686,017 | A | * | 8/1987 | Young | 205/234 |
| 5,169,514 | A | * | 12/1992 | Hendriks et al. | 205/247 |
| 5,178,745 | A | | 1/1993 | Abys et al. | 205/219 |
| 5,415,685 | A | * | 5/1995 | Paneccasio et al. | 106/1.21 |
| 6,743,346 | B2 | | 6/2004 | Gonzalez et al. | 205/257 |
| 2003/0047460 | A1 | | 3/2003 | Gonzalez et al. | 205/267 |

FOREIGN PATENT DOCUMENTS

| | | | | | |
|---|---|---|---|---|---|
| DE | 288291 | A | * | 3/1991 | C01G 55/00 |
| DE | 44 28 966 | A1 | | 2/1995 | |
| JP | 61099694 | A | * | 5/1986 | C25D 7/06 |
| RU | 2161535 | C2 | * | 1/2001 | B01J 37/02 |
| WO | 86/00652 | | | 1/1986 | |
| WO | WO 8600652 | A1 | * | 1/1986 | C25D 3/50 |

OTHER PUBLICATIONS

Abys, "Palladium Plating", Plating & Surface Finishing, (2002) 8, pp. 42-43, August.
PCT International Preliminary Report on Patentability (Form PCT/IB/373) issued Nov. 17, 2010 for Application No. PCT/EP2008/003667 (in English).
English translation of the PCT Written Opinion of the International Searching Authority (Form/ISA/237) issued Nov. 15, 2010 for Application No. PCT/EP2008/003667.
International Search Report for PCT/EP2008/003667 mailed Jan. 26 2009 in English and German.
Abys, "Palladium Plating", Plating & Surface Finishing, (Aug. 2002), pp. 42-43.
Simon et al., "Galvanische Palladiumschichten fur technische Anwendungen in der Elektronik", Galvanotechnik 5 (2002), Teil 1, pp. 1210-1217.
Simon et al., "Galvanische Palladiumschichten für technische Anwendungen in der Elektronik", Galvanotechnik 6 (2002), Teil 2, pp. 1473-1477.
Abys, "Palladium Plating", Plating & Surface Finishing, (2002) 8, pp. 42-43.
Kurtz et al., "Die Abscheidung von Palladium-Nickel-Legierungen aus chloridfreien Elektrolyten", Galvanotechnik, 99 (2008) 3, pp. 552-557.
Walz et al., "Die galvanische Palladium-Nickel-Abscheidung aus ammoniakfreien Grundelektrolyten mit Ethylendiamin als Komplexbildner", Metalloberfläche, 40 (1986) 5, pp. 199-203.
St. Burling "Precious Metal Plating and the Environment", Plating & Surface Finishing, (2007) 4, pp. 26-35.

* cited by examiner

*Primary Examiner* — Edna Wong
(74) *Attorney, Agent, or Firm* — Smith, Gambrell & Russell, LLP

(57) ABSTRACT

The present invention relates to an electrolyte for the electrochemical deposition of palladium or palladium alloys on metallic or conductive substrates. The invention likewise relates to a corresponding electroplating process using this electrolyte and specific palladium salts which can be advantageously used in this process.

16 Claims, No Drawings

PD AND PD-NI ELECTROLYTE BATHS

The present invention relates to an electrolyte for the electrochemical deposition of palladium or palladium alloys on metallic or conductive substrates. In particular, the electrolyte here is a Pd electrolyte containing, if appropriate, further metals and an organic oligoamine as complexing agent, by means of which alloy coatings comprising, for example, 80% of Pd can be deposited for technical and decorative applications. The invention likewise relates to a corresponding electroplating process using this electrolyte and specific palladium salts which can be advantageously used in this process.

The electrochemical deposition of palladium or palladium alloys on metallic substrates has a variety of decorative and technical applications. Electrochemically deposited pure palladium and palladium-nickel layers, if appropriate in each case with gold flash, are recognized materials for, for example, low current contacts or plug contacts (e.g. on circuit boards) and can be used as a substitute for hard gold [Galvanotechnik 5 (2002), 1210ff, Simon and Yasumura: "Galvanische Palladiumschichten für technische Anwendungen in der Elektronik"]. Palladium deposits having a very low layer thickness on lead frame can also replace the silver used in the bond region in semiconductor manufacture [Galvanotechnik 6 (2002), 1473ff, Simon and Yasumura: "Galvanische Palladiumschichten für technische Anwendungen in der Elektronik"].

Conventional palladium-nickel electrolytes contain ammonia and chloride and therefore represent a possible hazard to the health of operating personnel and are damaging in respect of corrosion of the plant material. Ammonia tends to vaporize at ambient temperature. Many electrolytes marketed are employed at from 40° C. to 60° C. and therefore cause strong emissions which are not only irritating to the bronchial passages but also lead to a decrease in the pH due to the vaporizing ammonia. The electrolyte therefore has to be kept at a constant pH by continual addition of ammonia.

Some ammonia- and/or chloride-free processes have become known to date. For example, one type contains organic amines, but these very quickly form carbonates under the prescribed alkaline operating conditions (up to 65° C., pH 9 to 12) and lead to precipitates. Furthermore, the unsatisfactory adhesion to nickel-plated substrates occurring in the case of such electrolytes has to be compensated by prepalladium processes, which result in additional costs (Plating & Surface Finishing, (2002) 8, pp. 57-58, J. A. Abys "Palladium Plating").

A chloride-free palladium-nickel electrolyte based on sulfate is described in an article to appear shortly (Galvanotechnik, 99 (2008) 3, pp. 552-557; Kurtz, O.; Barhtelmes, J.; Rüther, R., "Die Abscheidung von Palladium-Nickel-Legierungen aus chloridfreien Elektrolyten"). Although the coatings obtained therefrom have the desired properties, the electrolyte is an ammoniacal, weakly alkaline electrolyte, with the known disadvantages.

Another process using organic amines is known from U.S. Pat. No. 4,278,514 and operates at pH values of from 3 to 7. Such baths contain imide compounds (e.g. succinimide) as brightener. They are predominantly used for decorative purposes since they are pure palladium baths. The maximum current densities which can be employed are 4 A/dm$^2$. The baths described operate using phosphate buffers to set the pH. However, the incorporation of phosphorus into the layer deposited can have an adverse effect on the quality of the deposit.

The patent DE4428966 (U.S. Pat. No. 5,415,685) describes a palladium bath in which a combination of brighteners are mentioned in addition to a palladium compound (namely diamminepalladium dinitrite) and various ammonium salts (sulfate, citrate and phosphate). The ammoniacal process described operates in a pH range from 5 to 12. The brighteners claimed are a combination of sulfonic acid and an aromatic N-heterocycle. Mention is made of, inter alia, o-formylbenzenesulfonic acid and 1-(3-sulfopropyl)-2-vinylpyridinium betaine. Further pyridine derivatives mentioned are 1-(3-sulfopropylpyridinium betaine and 1-(2-hydroxy-3-sulfopropylpyridinium betaine. The latter two substances display, according to the authors, an adverse effect on the brightness of the deposit obtained.

As early as 1986, Raub and Walz described the electrochemical deposition of palladium-nickel coatings from an electrolyte based on ethylenediamine (Metalloberfläche, 40 (1986) 5, pp. 199-203, D. Walz and Ch. J. Raub, Carl Hanser Verlag, Munich, "Die galvanische Palladium-Nickel-Abscheidung aus ammoniakfreien Grundelektrolyten mit Ethylendiamin als Komplexbildner"). In this paper, it is explained that the complexing agent ethylenediamine is ideal for pushing the deposition potentials of the two metals together sufficiently for deposition of an alloy to be possible.

A process described in U.S. Pat. No. 6,743,346 also uses ethylenediamine as complexing agent and introduces palladium in the form of the solid compound of palladium sulfate and ethylenediamine. The salt contains from 31 to 41% of palladium (molar ratios of [$SO_4$]:[Pd] from 0.9 to 1.15 and [ethylenediamine]:[Pd] from 0.8 to 1.2). It is not soluble in water but dissolves in the electrolyte in the presence of an excess of ethylenediamine (Plating & Surface Finishing, (2007) 4, pp. 26-35, St. Burling "Precious Metal Plating and the Environment"). Although the salt makes it possible to introduce palladium using a smaller amount of ethylenediamine than is usual, this leads, as a result of the increase of the sulfate concentration, to an increase in the concentration of salts in the electrolyte and thus to a shortening of the lifetime of the bath. The substances 3-(3-pyridyl)acrylic acid or 3-(3-quinolyl)acrylic acid or salts thereof are added here as brighteners. It is mentioned that the brighteners based on sulfonates are not able, particularly at current densities of from 15 to 150 A/dm$^2$, to ensure the desired brightness in electroplating electrolytes.

In view of the background of the prior art cited, it was an object of the present invention to provide a further electrolyte and a process using this electrolyte, which help overcome the disadvantages mentioned. In particular, the electrolyte composition provided or the corresponding process should help to produce bright surfaces even at high current densities and fast electrolysis processes, which would be particularly advantageous from an economic and ecological point of view.

These objects and further objects which are not mentioned here but can be derived in an obvious manner from the prior art are achieved by the use of an electrolyte as disclosed herein. Preferred embodiments of the electrolytes of the invention are further defined in the claims. The invention also relates to a process according to the invention with its preferred possible embodiments further defined in the claims. Also disclosed herein is a constituent which can, according to the invention, be used advantageously in the electrolyte of the invention.

As a result of the use of an aqueous electrolyte for the electrochemical deposition of palladium or a palladium alloy on a metallic or conductive substrate, which electrolyte comprises organic oligoamine complexes of the metal ions to be deposited in the form of their salts with oxidehydroxide, hydroxide, hydrogencarbonate or carbonate as counter ions and a brightener based on an internal salt of a quaternary ammonium group and a sulfonic acid group, the stated object is achieved successfully in a surprisingly simple way. The electrolytes of the invention or the use of the process of the invention now make it possible to produce the desired bright surfaces of excellent quality at both low and high current densities. The electrolyte composition according to the invention is not in any way rendered obvious by the prior art.

The electrolyte of the invention makes it possible to deposit palladium alone or in the form of an alloy with other metals. As further metals, it is possible to use those which a person skilled in the art would consider for this purpose. They can be, for example, nickel, cobalt, iron, indium, gold, silver or tin or mixtures thereof. The metal ions to be deposited are preferably selected from the group consisting of nickel, cobalt, iron and mixtures thereof. These metals are present in the form of their soluble salts in the electrolyte. As salts, preference is given to those selected from the group of phosphates, carbonates, hydrogencarbonates, hydroxides, oxides, sulfates, sulfamates, alkanesulfonates, pyrophosphates, phosphonates, nitrates, carboxylates and mixtures thereof.

A person skilled in the art will choose the concentrations of the metals to be used in the electrolyte on the basis of general knowledge in the art. It has been found that advantageous results can be obtained when palladium is present in concentrations of from 1-100 g/l, preferably 2-70 g/l, and very preferably 4-50 g/l and very particularly preferably 5-25 g/l, based on the electrolyte.

The further metal ions to be deposited can be present in concentrations of ≤50 g/l, based on the electrolyte. The concentration of these ions in the electrolyte is preferably ≤40 g/l, more preferably ≤30 g/l, based on the electrolyte.

As already indicated at the outset, uniform deposition of the metal ions under the conditions according to the invention is advantageously obtained, inter alia, when these are present in complex form. Organic oligoamines have been found to be suitable ligands for these complexes. The use of polydentate ligands, in particular ligands based on diamines, triamines or tetraamines, is advantageous here. Particular preference is given to those having from 2 to 11 carbon atoms. Very particular preference is given to using ligands selected from the group consisting of ethylenediamine, trimethylenediamine, tetramethylenediamine, pentamethylenediamine, hexamethylenediamine, 1,2-propylenediamine, trimethylenetetramine, hexamethylenetetramine. Special preference is given to ethylenediamine (EDA) in this context.

A person skilled in the art has a free choice of the amount of oligoamines used. In estimating the amount, the fact that a sufficient amount has to be present in order to maintain very uniform deposition of palladium or palladium alloy will serve as a guide. On the other hand, at least economic considerations will limit the use of large amounts of oligoamines. An amount of 0.1-5 mol/l of oligoamines in the electrolyte is advantageous. The concentration is more preferably in the range 0.3-3 mol/l. The concentration of oligoamines is very particularly preferably 0.5-2 mol/l of electrolyte.

The pH of the electrolyte of the invention can be set by a person skilled in the art in the acidic to neutral range for the respective application. A range from pH 3 to pH 7 appears to be advantageous. Further preference is given to a range from pH 3.5 to pH 6.5, particularly preferably from pH 4 to pH 6 and very particularly preferably from about pH 5 to pH 5.5.

The electrolyte of the invention comprises brighteners based on an internal salt of a quaternary ammonium group and an acid group. As quaternary ammonium compound, preference is given to using one in which the positively charged nitrogen atom is part of an aromatic ring system. As such constituents of the molecule, a person skilled in the art will consider using, in particular, those having monocyclic or polycyclic aromatic systems, e.g. pyridinium, pyrimidinium, pyrazinium, pyrrolinium, imidazolinium, thiazolinium, indolinium, carbazolinium derivatives or substituted systems of this type. Very particular preference is given to using pyridinium or alkyl- or alkyenyl-substituted pyridinium derivatives. Especial preference is given to the choice of a brightener having a quaternary ammonium compound based on a pyridinium derivative as constituent of the molecule.

As further constituent of the molecule, the brightener contains an acid group, so that the brightener here is an internal salt or a betaine. For the present purposes, an acid group is a group which is predominantly present in deprotonated form under the conditions prevailing in the electrolyte. The acid group can be derived from acids selected from the group consisting of phosphoric acid, phosphonic acid, sulfuric acid, sulfonic acid, carboxylic acid. Particular preference is given to the sulfonic acid group as constituent of the brightener.

The acid group and the quaternary ammonium part of brightener can be joined by ($C_1$-$C_8$)-alkylene, ($C_1$-$C_8$)-alkenylene, ($C_6$-$C_{18}$)-arylene, which may be substituted.

Especially preferred compounds in this context have been found to be compounds selected from the group consisting of 1-(3-sulfopropyl)-2-vinylpyridinium betaine, 1-(3-sulfopropyl)pyridinium betaine and 1-(2-hydroxy-3-sulfopropyl)pyridinium betaine.

The brightener can be used in the electrolyte in amounts known to those skilled in the art. An upper limit is imposed by the amount of brightener at which the cost of its use is no longer justified by the effect achieved. The brightener is therefore advantageously used in amounts of from 1 to 10 000 mg/l of electrolyte. The brightener is particularly advantageously used in a concentration of 5-5000 mg/l of electrolyte, especially preferably in an amount of 10-1000 mg/l of electrolyte.

The electrolyte of the invention can contain further constituents which have a positive influence on the bath stability, the deposition behavior of the metals, the quality of the deposited material and the electrolysis conditions. Constituents of this type which will be considered by a person skilled in the art are, in particular, agents for reducing the internal stresses of the deposits, wetting agents, conducting salts, further brighteners or buffer substances, etc.

As additives for reducing the surface tension of the electrolyte, it is possible to use wetting agents selected from the group consisting of anionic wetting agents such as sodium lauryl sulfate, sodium dodecylbenzenesulfonate, sodium dioctylsulfosuccinate, nonionic wetting agents such as polyethylene glycol esters of fatty acids and cationic wetting agents such as cetyltrimethylammonium bromide.

To improve the conductivity and throwing power of the electrolyte, conducting salts selected from the group consisting of potassium and sodium sulfate, phosphate, nitrate, alkanesulfonate, sulfamate and mixtures thereof can advantageously be used. As buffer substances, use can advantageously be made of substances selected from the group consisting of boric acid, phosphates, carboxylic acids and salts thereof, e.g. acetic acid, citric acid, tartaric acid, oxalic acid, succinic acid, malic acid, lactic acid, phthalic acid.

As further brighteners, use can advantageously be made of brighteners selected from the group consisting of N,N-diethyl-2-propyn-1-amine, 1,1-dimethyl-2-propynyl-1-amine, 2-butyn-1,4-diol, 2-butyn-1,4-diol ethoxylate, 2-butyn-1,4-diol propoxylate, 3-hexyn-2,5-diol and sulfopropylated 2-butyn-1,4-diol or one of their salts. As further base brighteners, allylsulfonic acid, vinylsuifonic acid, propargylsulfonic acid or alkali salts thereof can be present in amounts of from 0.01 to 10 g/l of electrolyte.

As agents for reducing the internal stress in the coating, use can advantageously be made of substances selected from the group consisting of iminodisuccinic acid, sulfamic acid and sodium saccharinate.

It is likewise advantageous for deposition metal salts having no further inorganic anions apart from sulfate, nitrate, hydrogencarbonate or carbonate ions or oxide, hydroxide or mixtures thereof to be added to the electrolyte. This helps to prevent excessive accumulation of various anions in the system, since the deposition metal salts have to be supplemented by addition during the course of the electrolysis process. Such a procedure again has a positive effect on the operating life of the electrolyte. The embodiment in which only deposition metal salts whose anions are hydrogencarbonate or carbonate ions or oxide, hydroxide or mixtures thereof are used is particularly advantageous.

The present invention also provides a process for the electrochemical deposition of palladium or a palladium alloy on a metallic or conductive substrate, wherein an electrolyte according to the invention is used.

The palladium or the palladium alloy can be electrolytically deposited on substrates which will be known to those skilled in the art for this purpose. The metallic or electrically conductive substrates are advantageously selected from the group consisting of nickel, nickel alloys, gold, silver, copper and copper alloys, iron, iron alloys. Particular preference is given to coating nickel or copper or copper alloy with the palladium or palladium-containing layer according to the invention. However, conductive plastics can also be coated according to the invention by this process.

The temperature in the electrolytic deposition can be selected freely by a person skilled in the art. It is advantageous to set the temperature at which a desired deposition can occur. This is the case at temperatures of from 20° C. to 80° C. Preference is given to setting a temperature of from 30° C. to 70° C. and especially preferably from 40° C. to 60° C.

The current density to be set during the electrolysis according to the invention can likewise be selected by a person skilled in the art as a function of the electrolysis arrangement employed. The current densities are preferably from 0.1 to 150 A/dm$^2$. Particular preference is given to 0.1-10.0 A/dm$^2$ for barrel and rack applications and 5.0-100 A/dm$^2$ for high-speed applications. Especially preferred current densities are 5.0-70 A/dm$^2$ for high-speed applications and 0.2-5 A/dm$^2$ for barrel and rack applications.

The process of the invention is advantageously carried out using insoluble anodes. Particular preference is given to using insoluble anodes made of platinized titanium or mixed oxide anodes. These are very particularly preferably insoluble anodes composed of platinized titanium or of titanium or niobium or tantalum coated with iridium-ruthenium-tantalum mixed oxide. Anodes composed of graphite or resistant stainless steel are also possible.

The present invention likewise provides a specific palladium salt which is matched to and can advantageously be used in the process of the invention. This is a palladium complex comprising a divalent palladium cation, one or more bidentate, tridentate or tetradentate organic amine ligands and carbonate or two hydrogencarbonate or hydroxide anions or a mixture thereof. It is advantageous to use polydentate ligands based on diamines, triamines or tetraamines. Particular preference is given to those having from 2 to 11 carbon atoms. Very particular preference is given to using ligands selected from the group consisting of ethylenediamine, trimethylenediamine, tetramethylenediamine, pentamethylenediamine, hexamethylenediamine, 1,2-propylenediamine, trimethylenetetramine, hexamethylenetetramine. Special preference is given to ethylenediamine (EDA) in this context.

The preparation of the novel palladium-ethylenediamine compound can be carried out by reacting tetraamminepalladium(II) hydrogencarbonate [Alfa Aesar cat. No. 45082] with ethylenediamine in a molar ratio of [Pd]:[ethylenediamine]=1:1.0-3.0, preferably 1:1.5-2.5, particularly preferably 1:2.0-2.1 according to the following equation. The reaction temperature is preferably in the range from 20 to 95° C., particularly preferably from 40 to 90° C., very particularly preferably from 60 to 80° C.

$$[(NH_3)_4Pd](HCO_3)_2+2EDA \rightarrow [(EDA)_2Pd](HCO_3)_2+4NH_3$$

A ligand exchange of ammonia and ethylenediamine takes place. The ammonia liberated is partly given off immediately from the solution or is subsequently driven out by blowing air or inert gas such as nitrogen into the solution. To accellerate the removal of ammonia, a vacuum can additionally be applied. The other complexes according to the invention can be prepared in an analogous way.

In an electrolyte according to the invention described here, comprising, for example, 20 g/l of palladium as bis(ethylenediamine)palladium(II) hydrogencarbonate, 16 g/l of nickel as nickel(II) sulfate and 50 g/l of ethylenediamine, amounts of from 50 to 500 mg/l of the brightener 1-(3-sulfopropyl)pyridinium betaine or 1-(2-hydroxy-3-sulfopropyl)pyridinium betaine make it possible to deposit coatings having a high brightness, especially in the low current density area. In addition, the use of 1-(3-sulfopropyl)pyridinium betaine or 1-(2-hydroxy-3-sulfopropyl)pyridinium betaine in higher concentrations up to 2 g/l of electrolyte extends the current density range which can be employed. This makes it possible for the electrolyte described to be employed at current densities of up to 100 A/dm$^2$ for high-speed deposition.

A further indication of the advantageous effect of, for example, bis(ethylenediamine)-palladium(II) hydrogencarbonate in the electrolyte described is obtained when 1-(3-sulfopropyl)-2-vinylpyridinium betaine is used in very small amounts. Even 10 ppm make it possible to deposit mirror-bright coatings which have low stresses and are therefore highly ductile, even without the additional use of a sulfonic acid as described in U.S. Pat. No. 5,415,685.

Furthermore, the use of about 100-200 ppm of 1-(3-sulfopropyl)-2-vinylpyridinium betaine makes it possible to deposit very thick palladium or palladium alloy coatings. The layers having a thickness of up to 30 μm have a high brightness and are crack-free and very ductile.

The novel palladium-nickel electrolytes based on ethylenediamine likewise make it possible to avoid ammonia and chloride, as a result of which the hazard potential and odor pollution for human beings and plant corrosion are significantly reduced. The disadvantages of the previous ammonium- and chloride-free processes based on ethylenediamine are avoided. In particular, the use of carbonate or hydrogencarbonate as counterion to palladium and nickel makes it possible to increase the operating life. The anions used are not stable in the pH range from, for example, 3 to 5.5 which is employed and immediately decompose into carbon dioxide and hydroxide on addition of the metal salt. The volatile $CO_2$ is given off from the electrolyte and thus does not contribute to an increase in the bath density. During the electrolysis, the pH of the electrolyte decreases slightly, which compensates the alkaline effect of the hydroxide ion formed when carbon dioxide is given off. The pH during operation thus surprisingly remains automatically constant on addition of further palladium salts according to the invention. In contrast thereto, the bath density is gradually increased, especially in the case of sulfate, when the metal contents are supplemented during ongoing operation of the bath until finally the concentration of salts reaches a maximum value and the electrolyte is no longer stable.

This was not rendered obvious in view of the prior art cited.

EXAMPLES

Example Electrolytes

In a 5 l glass beaker, the indicated constituents of the electrolyte are dissolved in 4 l of deionized water. The palladium or the palladium alloy is subsequently deposited on a brass plate under the electrolysis conditions indicated.

Example 1

Electrolyte

Composition:

An electrolyte for the deposition of PdNi layers containing 80% by weight of palladium can, for example, have the following composition:

Electrolyte for High-Speed Deposition:

| | |
|---|---|
| 20 g/l of Pd | as bis(ethylenediamine)palladium(II) hydrogencarbonate |
| 16 g/l of Ni | as nickel(II) sulfate |
| 50 g/l of EDA | ethylenediamine |
| 500 mg/l of | 1-(3-sulfopropyl)pyridinium betaine |

Deposition Parameters:

| | |
|---|---|
| Temperature: | 60° C. |
| pH: | 5.0 |
| Current density: | from 5 to 70 A/dm$^2$ |
| Deposition efficiency: | 26 mg/Amin |
| Substrate: | copper or copper alloy, possibly with nickel underneath |
| Anodes: | Pt/Ti |

The coatings obtained (2 μm) are homogeneously shiny, bright, ductile, free of cracks and have a relatively constant Pd content of from 80 to 83% in the current density range indicated.

Example 2

Electrolyte

Electrolyte for Use with a Plating Rack:

| | |
|---|---|
| 10 g/l of | Pd as bis(ethylenediamine)palladium(II) hydrogencarbonate |
| 8 g/l of | Ni as nickel(II) sulfate |
| 30 g/l of | ethylenediamine |
| 100 mg/l of | 1-(3-sulfopropyl)-2-vinylpyridinium betaine |

Deposition Parameters:

| | |
|---|---|
| Temperature: | 60° C. |
| pH: | 5.0 |
| Current density: | from 0.5 to 5 A/dm$^2$ |
| Deposition efficiency: | 26 mg/Amin |
| Substrate: | copper or copper alloy, possibly with nickel underneath |
| Anodes: | Pt/Ti |

The coatings obtained (2 μm) are homogeneously highly shiny, brilliant, very ductile, crack-free and have a relatively constant Pd content of from 80 to 83%.

Example 3

Reaction of Tetraamminepalladium(II) Hydrogencarbonate with Ethylenediamine by Ligand Exchange with Ethylenediamine (EDA)

Apparatus:

Three-neck flask, stirrer, heater, thermometer, reflux condenser, pH electrode.

Starting Materials:

| Component | Mass [g] | Molar amount [mol] | Molar mass [g/mol] | Density [g/cm$^3$] | Volume [ml] |
|---|---|---|---|---|---|
| Palladium | 100 * | 0.940 | 106.4 | — | — |
| Ethylenediamine (EDA) | 117 | 1.947 | 60.1 | 0.898 | 130 |

* 277 g of tetraamminepalladium(II) hydrogencarbonate TAPHC (36% of Pd)
Molar ratio of Pd:EDA = 1:2.07

Quality of the Chemicals Used:

Tetraamminepalladium(II) hydrogencarbonate (product No. 45082) from Alfa Aesar ethylenediamine 99%, synthetic reagent (e.g. Merck No. 800947)

Procedure for 1 Liter Final Volume Containing 100 g of Pd:

1. Place 500 ml of deionized water in reaction vessel.
2. Add ethylenediamine to the water (pH 11.5 to 12).
3. Add tetraamminepalladium(II) hydrogencarbonate a little at a time, temperature rises to above 50° C. A golden yellow solution is formed. After addition of the full amount of the palladium salt, the pH is about 10.5.
4. Heat to 80° C. and allow to react for 1 h. On heating, the color of the solution changes from golden yellow to greenish yellow. A slight turbidity due to black particles is obtained.
5. Allow the mixture to cool to 50° C.
6. Filter through No. 6 glass fiber filter: a little black residue on the filter, light-yellow solution which smells strongly of ammonia.
7. Pass compressed air through the solution to reduce the ammonia concentration.
8. Make up to the final volume with deionized water.

The invention claimed is:

1. An aqueous electrolyte for the electrochemical deposition of palladium or a palladium alloy on a metallic or conductive substrate, comprising organic oligoamine complexes of (i) palladium metal ions or (ii) palladium metal ions and alloy metal ions, wherein the metal ions are present in the form of their salts with hydrogencarbonate or carbonate as counter ions, and a brightener based on an internal salt of a quaternary ammonium group and an acid group.

2. The electrolyte as claimed in claim 1, wherein the palladium is present in a concentration of 1-100 g/l.

3. The electrolyte as claimed in claim 1, wherein the alloy metal ions are selected from the group consisting of nickel, cobalt, iron, indium, gold, silver, tin and mixtures thereof in the form of their soluble salts.

4. The electrolyte as claimed in claim 1, wherein the alloy metal ions are deposited in concentrations of ≤50 g/l, based on the electrolyte.

5. The electrolyte as claimed in claim 1, wherein the organic oligoamine complexes comprise an organic oligoamine that is a diamine, triamine or tetramine derivative having from 2 to 11 carbon atoms.

6. The electrolyte as claimed in claim 5, wherein the organic oligoamine is present in the electrolyte in the range of 0.1-5 mol/l of the electrolyte.

7. The electrolyte as claimed in claim 1, wherein the pH of the electrolyte is in the range from 3 to 7.

8. The electrolyte as claimed in claim 1, wherein one or more compounds selected from the group consisting of 1-(3-sulfopropyl)-2-vinylpyridinium betaine, 1-(3-sulfopropyl) pyridinium betaine, and 1-(2-hydroxy-3-sulfopropyl)pyridinium betaine are used as the brightener.

9. The electrolyte as claimed in claim 1, wherein the brightener is present in amounts of from 1 to 10 000 mg/l of the electrolyte.

10. The electrolyte as claimed in claim 1, wherein no further deposition metal salts having inorganic anions apart from sulfate, nitrate, hydrogencarbonate, carbonate ions, oxide, hydroxide, or mixtures thereof are added to the electrolyte.

11. The electrolyte of claim 1, wherein the organic oligoamine complexes are palladium complexes comprising: a divalent palladium cation; one or more organic oligoamines selected from the group consisting of bidentate, tridentate, and tetradentate amine ligands; and hydrogencarbonate or carbonate as counter ions.

12. A process for the electrochemical deposition of palladium or a palladium alloy on a metallic or conductive substrate, comprising electrochemically depositing the palladium or the palladium alloy using the electrolyte as claimed in claim 1.

13. The process as claimed in claim 12, wherein the metallic substrate is selected from the group consisting of nickel, nickel alloys, gold, silver, copper, copper alloys, iron, and iron alloys.

14. The process as claimed in claim 12, wherein the electrochemical deposition is carried out at a temperature of from 20° C. to 80° C.

15. The process as claimed in claim 12, wherein current densities in the range from 0.1 to 150 $A/dm^2$ are set for the electrochemical deposition.

16. The process as claimed in claim 12, wherein the electrochemical deposition is carried out using insoluble anodes.

* * * * *